United States Patent [19]

Quest

[11] 4,161,795

[45] Jul. 24, 1979

[54] BOAT RAMP

[76] Inventor: Roland G. Quest, 50 Woodcrest Dr., St. Louis, Mo. 63124

[21] Appl. No.: 830,094

[22] Filed: Sep. 2, 1977

[51] Int. Cl.[2] ..... E04C 3/02

[52] U.S. Cl. ..... 9/1.6; 14/71.1

[58] Field of Search ..... 9/1.6, 1.7; 14/17.1

[56] References Cited

U.S. PATENT DOCUMENTS

| | | | |
|---|---|---|---|
| 2,179,005 | 11/1939 | Brachear | 14/17.1 |
| 2,641,785 | 6/1953 | Pitts | 14/17.1 |
| 2,669,733 | 2/1954 | Picker | 9/1.6 |
| 2,924,291 | 2/1960 | Tunstead | 9/1.6 |
| 3,106,826 | 10/1963 | Freidel | 61/48 |
| 3,468,280 | 9/1969 | Williams | 14/17.1 |
| 3,587,123 | 6/1971 | O'Boyle | 9/1.6 |
| 3,693,573 | 9/1972 | Murphy | 9/1.6 |

*Primary Examiner*—Trygve M. Blix
*Assistant Examiner*—D. W. Keen
*Attorney, Agent, or Firm*—Rogers, Eilers & Howell

[57] ABSTRACT

A portable landing ramp for boats which can be positioned manually has a walking plank having a first end secured to the boat by chains which support that end beneath the boat deck and thus reduce the angle of plank inclination, while a second plank end has foldable legs which are unfolded to extend to land to support the second end above the water, reduce the angle of inclination of the ramp, and add lateral stability to the ramp. A folding parallelogram hand rail assembly has braces in the upright position which support a pair of hand rails parallel with the plank to provide guidance while walking on the plank. The rear braces of the assembly are offset to position the first plank end away from the boat, and the chains extend around the outside of the rear braces to engage them and thereby reduce lateral movement of the plank. The chains and the assembly can be folded into channels in the plank and latched so that either hand rail can serve as a carrying handle for the ramp. The chain is secured to the boat by low profile clips which align the principal lines of force exerted through the chain with the strongest part of the clip.

17 Claims, 13 Drawing Figures

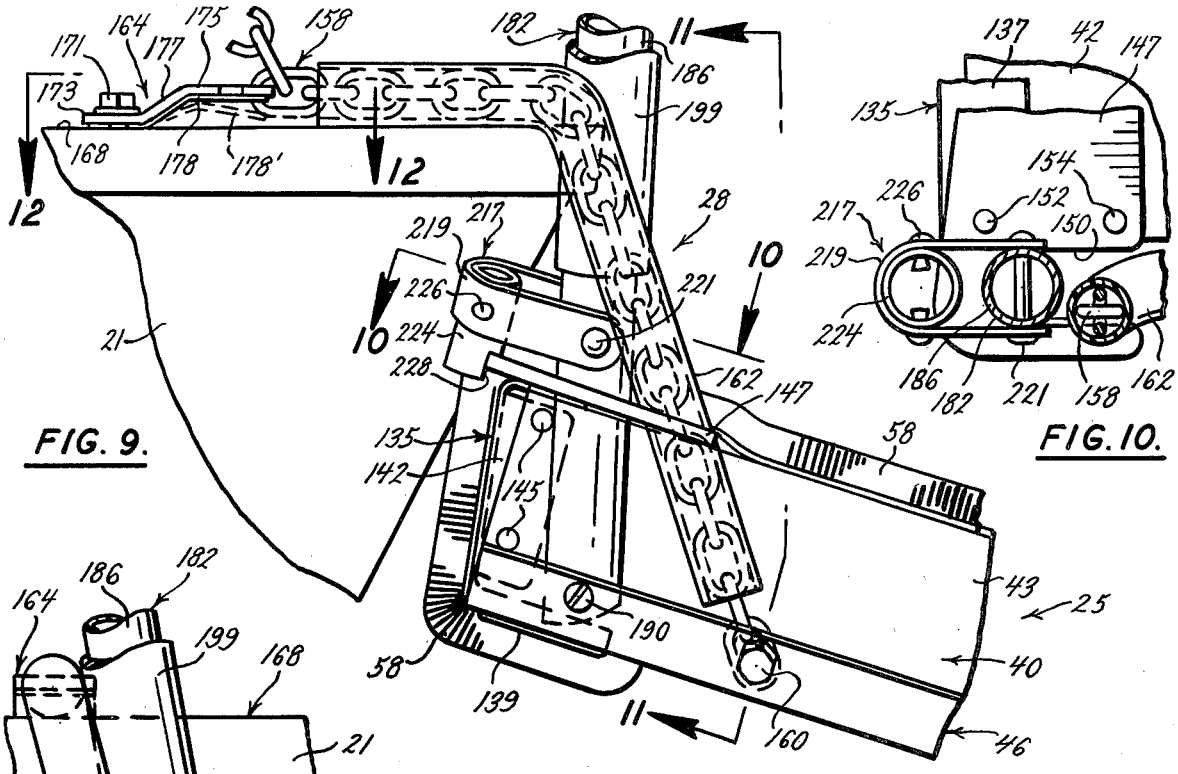
FIG. 9.
FIG. 10.
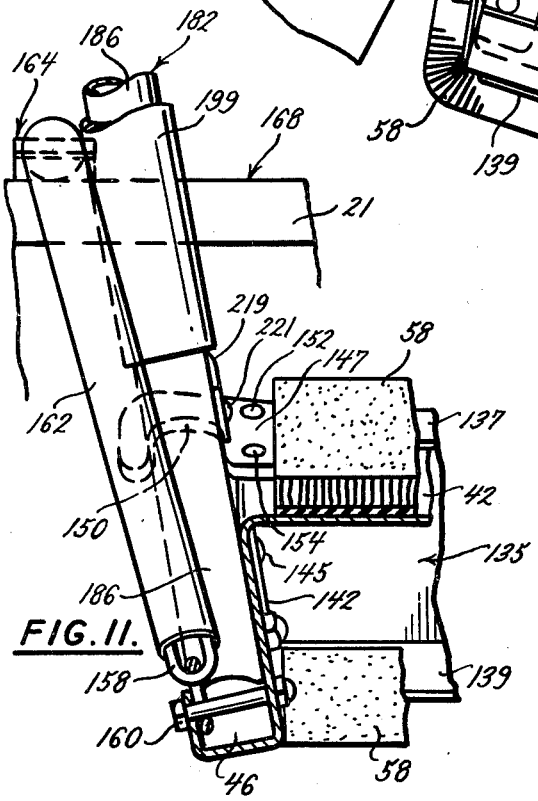
FIG. 11.
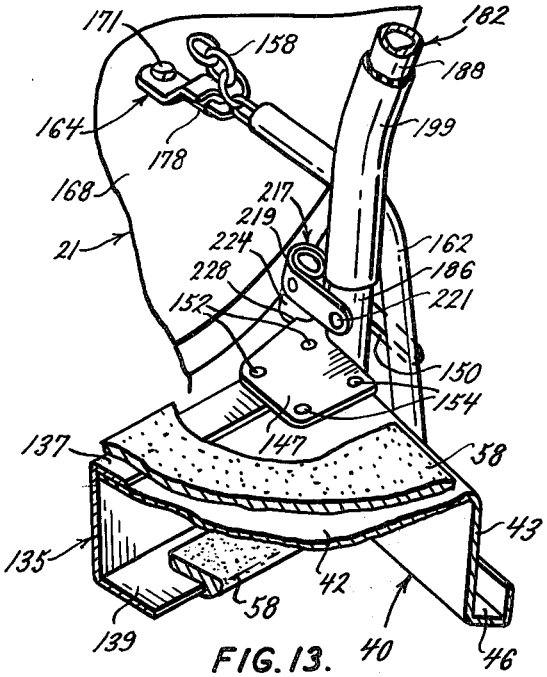
FIG. 13.
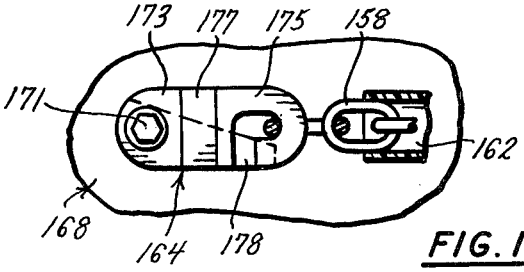
FIG. 12.

BOAT RAMP

BACKGROUND AND SUMMARY OF THE INVENTION

This invention pertains to ramps used to allow human ingress and egress to and from a boat to land, and is more particularly concerned with a portable ramp for such purposes having components which can be folded into the ramp plank and easily carried, and unfolded so that it can be mounted to the boat and near the land to provide ramp stability and safety during ingress and egress. In the prior art, ramps have been positioned to allow people to walk from a boat to the land and vice versa. Some of these ramps have legs which extend from a plank to provide ramp support, and others have hand rails which extend from the plank to provide grasping to allow passengers to maintain their balance. However, there has existed a need in the art for a ramp having a plank which can be positioned near a boat in a fashion to keep the boat end of the plank away from the boat so that it will not jar against it and to support the plank in a manner to reduce the angle of inclination of the plank. When the angle of inclination is too steep, a passenger walking on the plank can stumble or lose balance and fall into the water. There has also existed a need in the art to attach the ramp to the boat so that it will be securely held but free to move or articulate as the boat moves on the waves.

There has furthermore been a need in the prior art to have a portable ramp which can be carried by grasping a hand hold which serves another function other than being a hand hold. There has furthermore been a need for a compact ramp operable by a single person and of convenient shape for storage purposes. It is also desirable to make a plank which has formations which can be used for functions other than passenger support.

The present invention supplies the aforementioned needs in the prior art. The ramp of the present invention has a walking plank which has its boat end secured to the boat by chains so that the boat end is supported beneath the level of the deck while the land end of the plank is supported by outwardly extending legs which rest on the bank and provide a wider base for the plank. The supporting of the boat end beneath the deck and the raising of the land end above the land decreases the angle of inclination of the walking plank relative to the boat and to the land, thus making ingress and egress over the plank safer and more convenient for the passengers. The suspension of the boat end beneath the deck provides a convenient step for the passengers to ascend from the plank to the boat deck.

The invention further comprises a parallelogram-shaped hand rail assembly which includes a pair of hand rails which in the unfolded position are parallel to the plank and supported by braces extending from the plank to the end of the rails. The rear braces extend from the boat end of the plank and curve to their connections to the end of the hand rails so that the curvature positions the boat end of the plank away from the boat to prevent plank instability by bouncing and rubbing against the boat stern or side. The ramp is made quite narrow for light-weight in handling and storage; however, the pivot axes of the braces are canted so that while the braces stow along the outside of the ramp, when they are extended, they move outward giving adequate hip clearance for users of the ramp. The curvature of the rails permits the upper end of the rails to clear the boat railing.

The chains extend from the exterior sides of the plank around the outsides of the rear brace to trap the braces when the chains are secured to the boat, and by such engagement provide lateral support to prevent the plank from turning sideways and wobbling. The rounded end at the ramp on the land and the mechanics of the chain/ramp attachment minimizes the digging in of the ramp into the land or sand when the boat moves or turns. The mechanics of the chain/ramp attachment refers to the tilting of the ramp so as to raise one side of the ramp and permit it to plane over the sand. The chains are engaged to the boat by low profile pivotal clips which by their pivotal action allow the clip to maintain alignment with the direction of chain extension as the chains are moved by the waves which move the boat.

The parallelogram hand rail is unfolded until the supports engage in U-shaped retainers and when such engagement occurs a single person can easily maneuver the ramp by placing his foot against the boat end of the plank and by grasping the hand rails.

The present invention is portable and easy to operate. When the ramp is to be disengaged and returned to the boat the upper end of the ramp is placed on the boat and the chains are disengaged from the deck latches and are placed within channels formed unitary with the plank. Then the parallelogram rail arrangement is folded in parallelogram fashion so that the components of the assembly also lie within the channels and are held therein by hooks extending from the plank so that the hand rail can be grasped to carry the ramp. The support legs also fold beneath the ramp into cavities within the plank so that they do not project from the ramp. THe various structural members are therefore foldable into light-weight compact and easily portable shape which a single person can maneuver with ease. The present invention thus provides improvements in safety, convenience, and structural ultization long needed in the art.

DESCRIPTION OF THE DRAWINGS

FIG. 9 is a side view of the rear end of the ramp showing the chains secured to the clips and to the ramp and showing the hand rail assembly in the upright position, with the spring latches for the clips shown in phantom lines;

FIG. 10 is a section of the ramp taken on the line 10—10 of FIG. 9;

FIG. 11 is a section of the ramp taken on the line 11—11 of FIG. 9;

FIG. 12 is a top view of one of the low profile pivotal clips showing a chain link secured within the clip opening;

FIG. 13 is a top perspective view of the right rear corner of the ramp showing some parts broken, and showing the hand rail assembly in the upright position.

DESCRIPTION OF THE PREFERRED EMBODIMENT

Figures 1, 4:
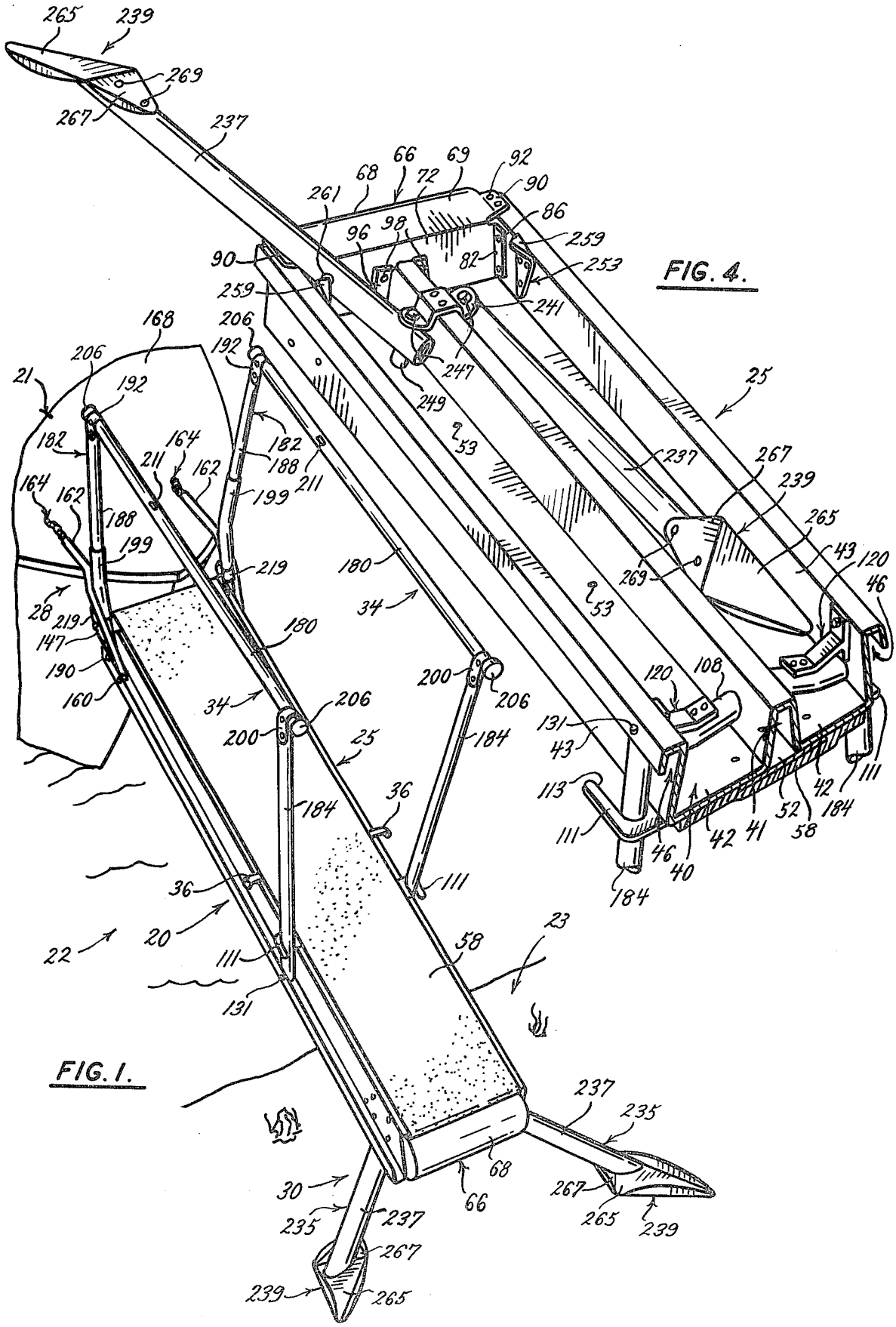
FIG. 1 is a perspective view of the ramp showing it mounted to a boat and supported upon land, with the hand rail assemblies in the upright position and with the land support assembly extended to rest on the land.
FIG. 4 is a view of the underside of the front end of the ramp showing one land support leg in the extended position and the other support leg folded into the underside of the plank.

The ramp generally depicted as 20 is shown in FIG. 1 in a setting with a boat 21, water 22 and land 23. The ramp has the purpose of providing safe passage from the boat to the land, the land being considered as the landing base for purpose of this description. The end of the ramp near the boat in FIG. 1 will hereinafter be referred to as the boat end or near end, and the end near land as the land end or front end. The ramp 20 generally comprises a longitudinal plank 25, a boat end support assembly 28 located near the boat end of the ramp, and a landing base support assembly 30 positioned near the land end of the ramp. The ramp 20 further comprises a pair of parallelogram hand rail assemblies 34 located on either side of the plank. The plank 25 has cavities for receiving support assembly 28, the land support assemblies 30, and the rail assemblies 34 can be latched to the plank by hooks 36 to permit the entire ramp 20 to be carried by grasping a hand rail.

More specifically the plank 25 has a principle longitudinal beam 40 which extends for the greater length of the ramp. The long beam 40, which can be aluminum is a unitary sheet crimped symetrically so as to provide a central longitudinal U-groove 41, a pair of top flat sections 42, and side legs 43, which slant inwardly towards the center of the plank. The legs 43 extend downwardly into feet forming longitudinal channels 46 which receive the folded support assembly 28 and the rail assembly 34 as will be described. A longitudinal top cover sheet 52 of light weight aluminum is secured to the top flat sections 42 by a plurality of rivets 53, (FIG. 3) and covers the central groove 41 to prevent one from stepping in the groove while walking on the plank. Mounted on top of the plank is a carp 58, which is secured to the top of flat sections 42 and cover sheet 52 by adhesive cement and by rivets to provide traction for those walking on the plank. Sections of the carpet with its tufting are shown in FIGS. 6–11, and 13, and the ends of the carpet are secured to the plank in a manner to be described.

At the land end of the plank 25 is an end piece 66. As seen specifically in FIGS. 4 and 7, piece 66 has a curved U shaped section 68 with a lower horizontal leg 69 and an upper horizontal leg 70. Leg 69 extends into a vertical back flange 72. Flang 72 extends upwardly into a horizontal flange 74 which passes flush above the horizontal leg 70. Rivets 78 pass through carpet 58 and secure flange 74 to the upper horizontal leg 70 and to the sections 42 of long beam 40. Extending rearwardly from vertical flange 72 of end piece 66 are two vertical side flanges 82 which are secured to the inside of the plank legs 43 by rivets 86. Extending outwardly from the bottom U leg 69 are a pair of flat flanges 90 which are slanted so that they lie flat against the bottom of channels 46 to which they are secured by rivets 92 as seen in FIG. 4. The front end of central plank groove 41 has laterally extending flanges 96 which lie flush against the rear side of flange 72 and are secured thereto by rivets 98. The rivets 86, 92 and 98 thus secure the end piece 66 firmly to long beam 40. The front edge of carpet 58 is wedged between the top sections 42 and the upper U leg 70 and held therein by riveting these two elements together.

Figure 5:
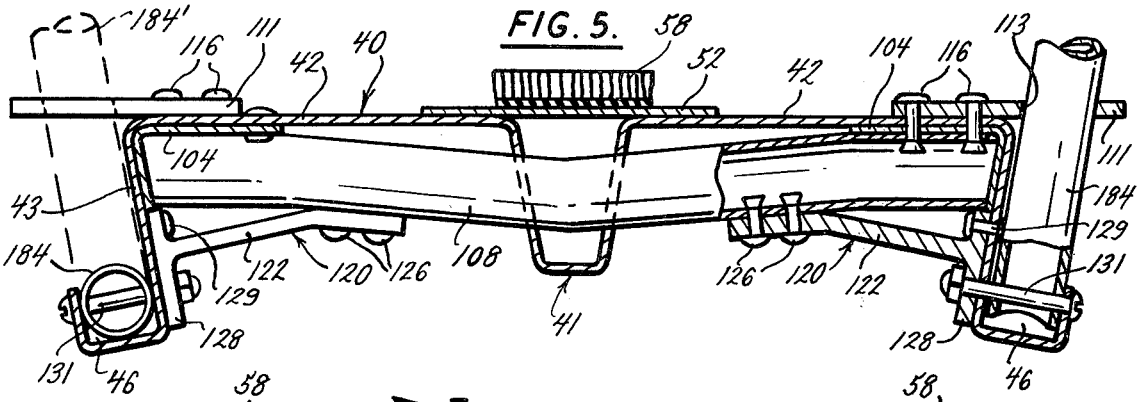
FIG. 5 is a section of the ramp taken on the line 5—5 of FIG. 2 showing some of the ramp parts broken, and showing on the right side the hand rail assembly in the upright position, and on the left side showing the hand rail assembly in the lowered position with solid lines, and in the upright position in phantom lines.
Figure 8:
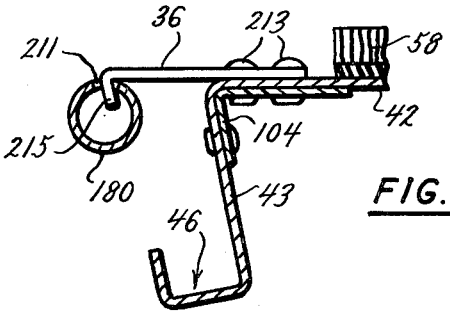
FIG. 8 is a ramp section taken on the line 8—8 of FIG. 2, showing the hand rail in the lowered position, with the end of the latch extending within an opening in the hand rail.

Plank 25 has a pair of reinforcing angles 104 which extend over approximately the center half of the plank. As seen in FIGS. 5 and 8, the angles 104 are shaped so that their legs fit flush against the insides of the long beam top sections 42 and legs 43.

Near the middle of long beam 40 a cross tube 108 having a slight V bend extends laterally through conforming bores in the side walls of central groove 41, so that the ends of the tube 108 fit flush against the inside of legs 43, as seen in FIG. 5. Secured to the tops of long beam sections 42 directly above the ends of tube 108 are a pair of flat support plates 111, each of which have U-shaped slots 113 for receiving braces of the rail assembly as will be described. Rivets 116 extend through the upper walls of tube 108, through the tops of angles 104, through top sections 42 and support plates 111 to firmly secure those members together on both sides of the plank.

Beneath tube 108 are tube support brackets 120, each of which has a laterally extending arm 122 secured to the underside of tube 108 by rivets 126, and a downwardly extending side 128 which fits flush against the inside of leg 43 and is secured thereto by a rivet 128, as well as by a bolt 131. Bolts 131, as seen in FIG. 5, cross channels 46 and act to secure brace rods of the rail assembly as will be described.

At the rear end of long beam 40, a C-shaped channel beam 135 (FIG. 13) with upper and lower flanges 137 and 139 respectively, has its upper flange 137 positioned flush against the top sides of beam sections 42. C Beam 135 has at its side ends forwardly extending flanges 142, as seen in FIGS. 9 and 11, which are slanted so as to fit flush against the inside of long beam legs 43 to which they are firmly secured by rivets 145.

Located at the rear corners of long beam 40 above the top sides of sections 42 are flat support plates 147 which are similar to support plates 111, and which also have U slots 150. A rear pair of rivets 152 extend through each support plate 147, the upper flanges 137, and sections 42, to firmly secure those members, and a front pair of rivets 154 secure each plate 147 to its respective top section 42. As seen in FIG. 13, the carpet 58 extends rearwardly around the outside of C beam 135 and folds under and then over bottom flange 139 to which it is secured as by adhesive or riveting.

The boat end support assembly 28 comprises a pair of link chains 158 which have their lower links secured in the plank channels 46 by bolts 160 (FIG. 11) which extend through the links and the legs 43 across the channels 46. Each chain 158 extends through a flexible transparent plastic sheath 162. The top ends of the chains 158 are secured to low profile pivotal clips 164 which can be of steel, and are mounted on the deck 168 of boat 21 by bolts 171. Each clip 164 comprises bottom and top parallel flat sections 173 and 175 joined by a flat diagonal middle section 177. The top clip section 175 each have slotted openings which allow passage of a chain link for insertion within the center of the clip openings. The chains are held within the clip openings by flat spring latches 178 which can be of steel. Latches 178 have flat sections that correspond in contour to the flat sections 173, 175 and 177 of the clips 164 so that the latches can fit flush against the underside of the clips. The latches are shaped as shown in hidden lines in FIG. 12, so that the smaller ends of the latches extend across the side of the clip openings while the larger end of the latches are secured to the underside of clip section 173 by a spot weld located to the right of bolt 171 in FIG. 12. The small end of the latches 178 can be forced down by one link of the chain to the position shown in phantom lines as 178' in FIG. 9, to allow passage of the chain link into the center of the clip opening and then the latch springs back to block the opening to hold the chain link therein. The bolt 171 extend through the clips 164 and latches 178 to pivotally attach them to the deck, which allows the clips to pivot and maintain alignment with the chain as the lines of force of the chains change with movement of the ramp relative to the boat.

The chains 158 have a width that permits them to fit snugly within the plank channels 46 when they are disengaged from the clip 164. The chains 158, being secured to the clips 164 and to the plank 25, permit the plank to be suspended a selected distance beneath the boat deck, the distance being dependent upon which chain links are selected to be engaged to the clips.

Each of the two hand rails assemlies 34 comprises a cylindrical hand rail tube 180, shown in the extended position in FIG. 1 substantially parallel to the plank, and rear and front cylindrical brace tubes 182 and 184, respectively, which support the ends of the hand tube 180.

Figures 2, 3:
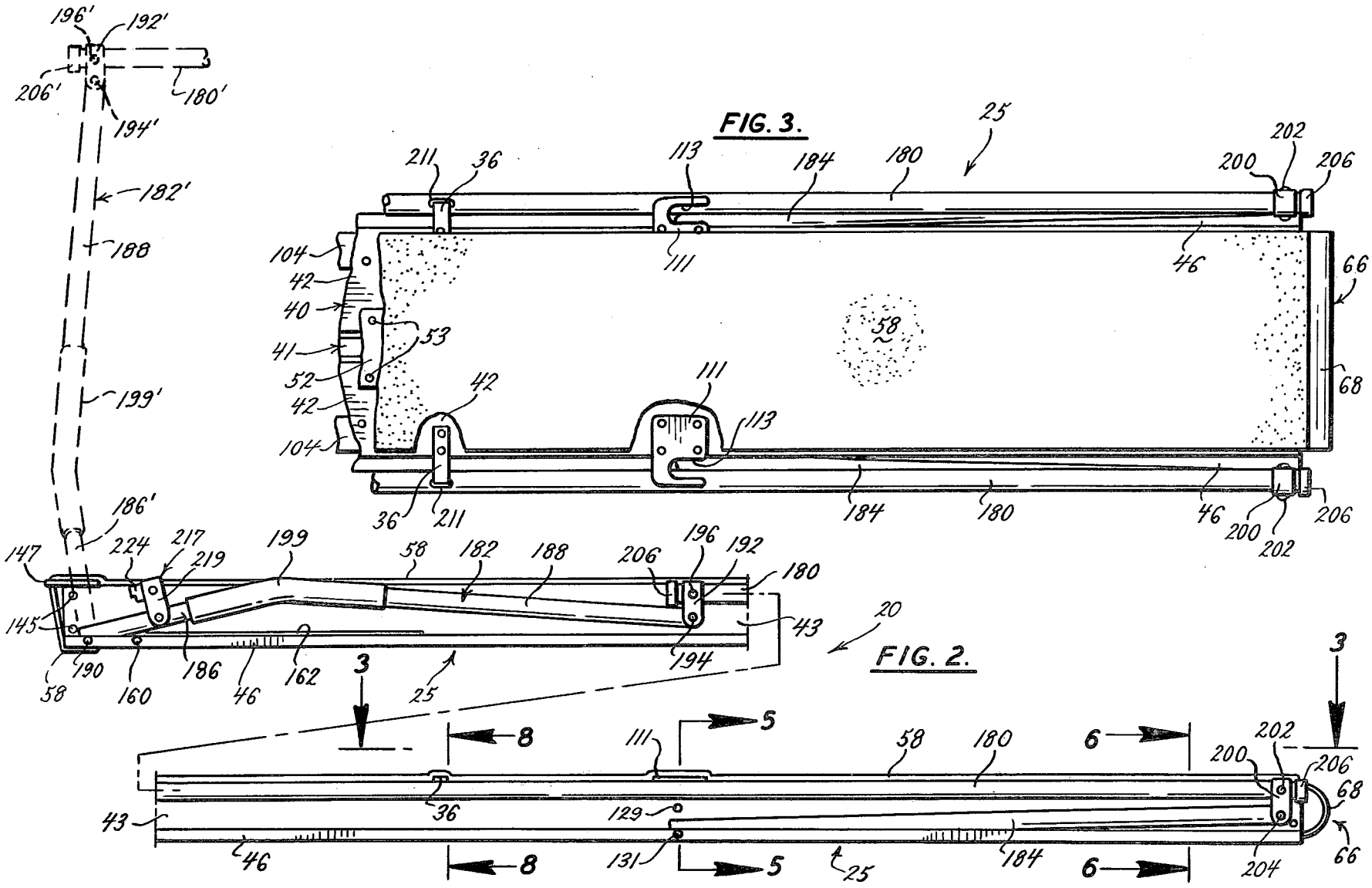
FIG. 2 is a side view of the ramp shown divided into the sections with approximately the rear one third of the ramp being shown separate. The hand rail assembly is shown in the lowered position in solid lines, while phantom lines show a rear part of the hand rail assembly elevated.
FIG. 3 is a top view of the ramp taken on the line 3—3 of FIG. 2, showing some parts broken.

The rear brace tubes 182 are bent as seen in FIGS. 1, 2 and 13 to form shorter lower segments 186 and longer upper segments 188. The bottoms of the rear braces are pivotlly secured within the ramp side channels 46 by bolts 190 (FIG. 9) which pass through lower segments 186 and the sides of channels 46. At the upper end of rear brace segments 188 (FIG. 2) U-shaped brakets 192 have their two legs pivotally secured to the upper end of segments 188 as by a loose rivet 194 (FIG. 2) which passes through those legs and the top of tube 188, while the hand rails 180 fit snugly inside the curved portion of the brackets 192 and are firmly secured thereto. Flexible plastic bumper sleeves 199 fit around the rear braces and act to prevent the marring of the boat by the braces. They also serve to increase the friction of the rear braces against the boat, and thusly increase the lateral stability of the ramp.

The front braces 184 are straight tubes, and have their lower ends secured within the plank channels 46, by the bolts 131, as seen in FIG. 5, so that the braces 184 can pivot within the channels 46. The upper ends of the front braces 184 are also pivotally secured to the front ends of the hand rails 180 by U brackets 200 (FIGS 1 and 6) whose curved portions fit snugly around the hand rails 180 and are firmly secured to the hand rails by bolts 202 which extend through the brackets 200 and the hand rails 18. The legs of the U brackets 200 are pivotally secured to the upper ends of braces 184 by loose rivets 204 extending through the legs of the brackets and through the upper ends of braces 184.

The ends of the hand rails 180 are covered by plastic caps 206. (FIG. 1)

Figure 6:
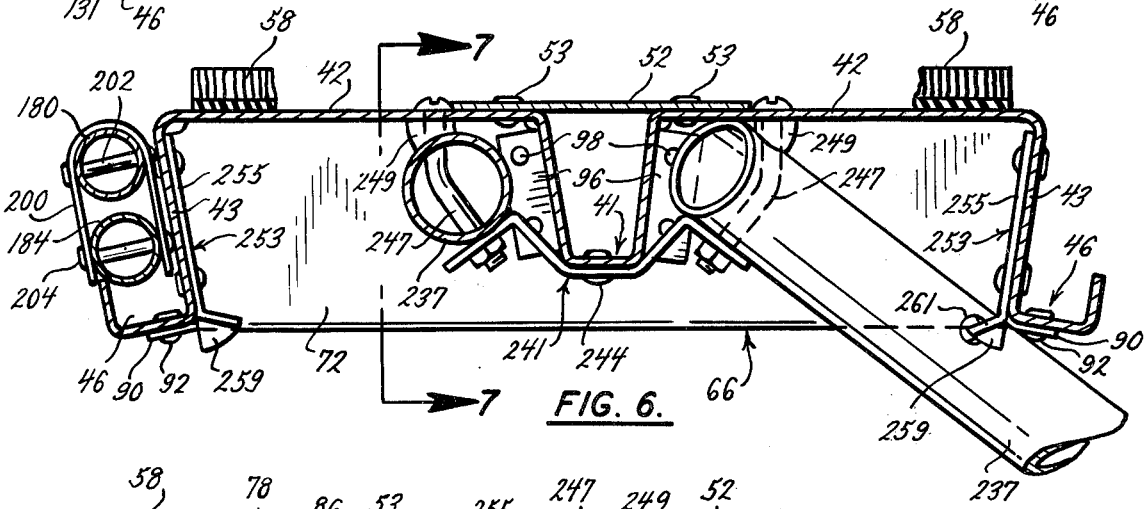
FIG. 6 is a section of the ramp taken on the line 6—6 of FIG. 2, but showing the landing base leg on the left in the folded position, and the leg on the right in the extended position, and showing the hand rail assembly on the left side lowered and the hand rail assembly on the right side removed for clarity.
Figure 7:
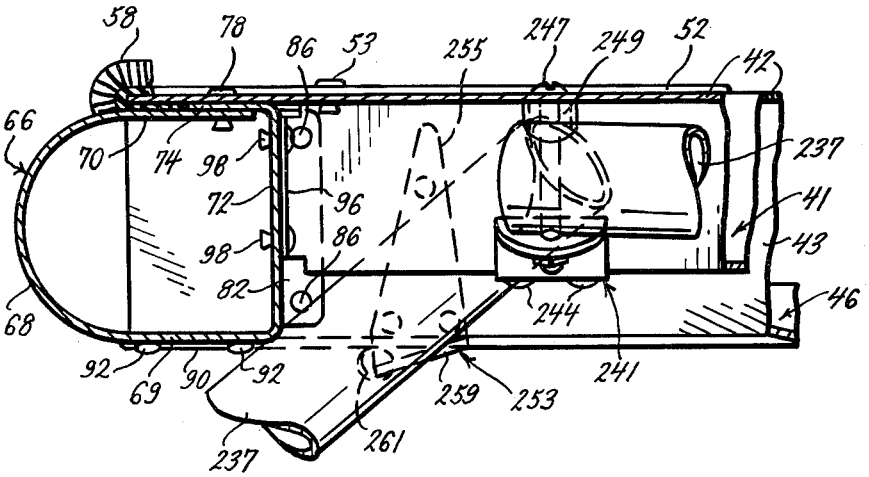
FIG. 7 is a section taken on the line 7—7 of FIG. 6, showing the leg in the extended position in phantom lines and in the folded position in solid lines.

There is sufficient clearance between the bottoms of the braces 182 and 184 and the bottoms of the channels 46 to allow a full pivotal movement of the braces from the lowered position shown in FIG. 2 in solid lines to the upright position shown in FIG. 1. There is also sufficient clearance between the tops of the braces 182 and 184 and the hand rails 180 to permit pivotal movement of the braces relative to the hand rails for extension from the lower to the raised position, FIG. 6 illustrates such clearance for a front brace.

Each hand rail 180 has a latching hole 211 in its top side. The latching hooks 36 are secured to the top sections 42 and the support angles 104 on either side of the ramp by rivets 213 so that the prongs 215 of the hooks 36 can extend into the holes 211 (FIG. 8) when the hand rail is in the lowered position, to hold the rail in that position for carrying the ramp.

Means are also provided to lock the handrail assemblies when they are in the upright position. The lower segments 186 of the rear braces have pivot latches 217 (FIG. 9) which latch the rear braces 182 to the rear part of the plank. See FIGS. 9, 10 and 13. Each latch 217 comprises a U-shaped member 219 which has its two legs pivotally secured to the lower brace segment 186 by a bolt 221. A metal tube 224 is snugly secured against the curved interior side of the U member by rivets 226. The tube 224 has a notch 228 in its lower wall. When the hand rail assemblies are raised to the upright position, the rear braces 182 are upright and the latches 217 pivot counterclockwise (as viewed looking at FIG. 9) so that the notches 228 fit against the rear edges of the rear support plates 147 (FIG. 9) to resist forwrd movement of the rear braces 182 and lock the assemblies 34 in the upright position. Each latch 217 can be disengaged from this locked position by pivoting the latch 217 upward and bolt 221 by the hand to disengage the notch 228 from the support plate 147.

When the hand rail assemblies are in the upright position as shown in FIG. 1 the chains 158 pass around the outside of the rear braces 182 and the chain cover sheathes 162 restrain the plastic brace sleeves 199 from lateral movement of the ramp thus improving ramp stability.

The landing base support assembly 30 comprises a pair of legs 235 located at the front of the ramp, the legs are shown in the extended position in FIG. 1, while FIG. 4 shows one leg in the extended position and the other leg folded within the plank. Each leg 235 comprises a cylindrical thigh tube 237 with a shoe 239 at its lower end. To secure the legs to the plank 25, a butterfly bracket 241, (FIGS. 4 and 6) has its midsection secured to the bottom of plank long beam groove 41 by a pair of rivets 244. The upper ends of the thigh tubes 237 are pivotally secured to the end flaps of the butterfly bracket by curved bolts 247 which extend through those flaps and through long beam sections 42, sleeves 249, and the upper ends of the legs 237. On the interior sides of the long beam legs 43 at the front end of the plank are lock plates 253 (FIGS. 4 and 6) which each have a upper flat triangular segment 255 secured by three rivets to each long beam leg 43, and a lower inwardly extending triangular shaped toe 259. The thigh tubes 237 each have lock holes 261 which receive the toes 259 to lock the legs in the extended support position, as seen for the extended leg 235 in FIG. 4.

The shoes 239 each have a triangular shaped sole segment 265 and a triangular shaped heel segment 267 that is bent angularly from the sole 265. The shoes 239 are each secured to thighs 237 by a pair of rivets 269.

The components of the plank 25, the hand rail assemblies 34, the end base support assembly 30, and the boat and support assembly 28 are preferably of light weight aluminum or aluminum alloy except where otherwise indicated.

Operation

The ramp 20, being of light weight, can be operated by an individual to be placed in the dismounting position. For purposes of demonstration the ramp 20 is initially in the folded position shown in FIG. 2, with the boat support assembly chains folded into the long beam channels 46, the hand rails assemblies 34 down and locked in position, and the legs 235 folded beneath the plank. The operator may first turn the plank 25 upside down and grasp each of the legs 235 and move it upward out of the confines of the long beam side leg 43 and the wall of the longitudinal groove 41, and then pivot the leg 235 about its connecting bolt 247 until the leg is in position for insertion of the toe 259 within the thigh lockhold 261, as shown for the leg on the left side of FIG. 4. Each leg 235 is moved to this extended locked position, and then the ramp 20 can be turned top side up with the legs either extending over the edge of the boat, supported on the boat deck, or placed on the landing base.

Next, the hand rail assemblies 34 can be erected. This is done for each hand rail assembly by pressing downward on the hand rail 180 to disengage the latch prong 215 from the latchhole 211 (FIG. 8) and then moving the hand rail 180 slightly outward so that it is no longer underneath latch 36. The handrail 180 is then lifted upward and as it is moved upward it pivots about its connections to the rear and front braces 182 and 184 and pivotally lifts those braces upwards about their pivotal connections to the plank. The assembly 34 maintains a parallelogram appearance as it is lifted. The assembly 34 is lifted until the rear brace 182 and front brace 184 simultaneously engage the U slots 113 and 150 of their support plates 147 and 111 respectively, such engagement resisting further rearward movement of the braces. When the rear brace 182 is fully extended within its support plate 147 the pivot latch 217 has flipped downward so that the notch 228 engages the rear edge of plate 147 to lock the hand rail assembly as previously described. Each assembly 34 is raised to this locked position, and the U slots 113 and 150, which are slightly wider than the braces, provide lateral support for the braces.

Next, the operator can grasp with each hand one of the hand rails 180 and press his foot against the back side of the C beam 135 at the rear of the plank. The operator can then lift the hand rails 180 and press the sole of his foot against C beam 135 to lift the ramp upwards, keeping the front end of the ramp slanted upward relative to the rear end. With the ramp so elevated the operator can swing the ramp to the position desired near the pivot clips 164 and rest the ramp on the deck, or rest the front of the ramp on land if desired. The operator can then remove each of the chains 158 from the plank channels 46 and insert the desired chain link into the clip 164 opening by pressing the spring latch 178 downward to the position shown in phantom lines in FIG. 9, and then inserting the link through the side of the clip opening into the center of the opening to the position shown in FIG. 12, and then releasing the spring latch 178 so that it springs back to the position shown in solid lines in FIG. 9. Each chain 158 is so engaged to its respective clip 164 to support the rear end of the plank 25 at the desired level beneath the deck. The ramp 20 is then moved by grasping the hand rails and placing the foot against the rear of the plank as aforesaid, the legs 235, (if not previously placed on the land) are placed on the land so that their shoes 239 are on the land as shown in FIG. 1. The ramp 20 in the FIG. 1 position has the chain sheathes 162 extended around the outside of the rear braces 182 in frictional engagement with the brace sleeves 199 to resist lateral movement of the plank 25. The rail assemblies 34, because of the slanted nature of the long beam side legs 43, tilt outwardly away from the plank so that the width between the hand rails 180 is greater than the width of the plank 25, and the width between the front and rear braces 184 and 182 increases from the bottom to the top of the braces. This upwardly extending taper of the rail assemblies 34 permits greater room for passage in the area of the hips of the passengers and thus allows a greater width of passage than provided by the width of the plank.

The chains 158, being flexible permit the boat to move on the waves without rigidly jarring the ramp. The chains allow the angle of inclination of the plank 25 to be controlled according to the chain link selected to be secured to the clips 164, and the location of the plank beneath the boat deck provides a convenient step from the plank to the deck. The angle of inclination of the plank can therefore be adjusted according to the relationship of the landing base to the boat to avoid too steep of an angle.

The offset lower segments 186 of the rear braces 182 place the end of the plank 25 away from the boat to keep the plank from bumping against the boat.

The landing base legs 235 extend outwardly from the plank 25 thus providing a broad base for support and improvement in the stability of the landing end of the plank.

If the plank 25 is moved by the waves or by a person, the pivot clips 164 pivot with movement of the chains 158 so that the clips maintain alignment with the forces exerted through the chains and utilization of the maximum strength of the clips 164 is realized. The chains 158 also support the plank 125 in a fashion so that if the boat is moved the plank 25 will tilt upward toward the direction of plank movement. The ramp 20 can also be used without extending the legs, in which case the bottom of the front end of the plank 25 rests on the landing base to support the front of the ramp so that the legs 235 will tilt in a direction that will prevent them from digging into the landing base.

After the ramp has been used, it may be returned to its folded position by disengaging the legs 235 from the latches 253 and folding the legs 235 back into the underside of the plank. This may be done on the landing base if desired. The plank 25 can be lifted back onto the boat by grasping the hand rails 180 as aforesaid and lifting the plank upwards until the operator's foot can be pressed against the rear of the plank so that the plank can be moved to the position desired on the boat. When the ramp is placed in a stable position on the boat, the chains 158 can be disengaged from the clips 164, and the chains can be layed lengthwise in the long beam side channels 46. The hand rail assemblies 34 can then be folded by disengaging the notches 228 of latches 217 from the support plates 147 and pivoting the assemblies 34 forward and downward towards the plank. The rails 180 are moved around and under the latches 36 so that the latch pronges 215 can extend into the rail latch holes 211 as shown in FIG. 8. This is done for each hand rail assembly and when the hand rails 180 are so locked the entire ramp can be carried by grasping either one of the hand rails 180 by a single hand and lifting it and the ramp upward so that the ramp extends sideways.

Thus there has been provded a novel ramp which is easy to operate, provides stability in operation, and adjustability in use, but is compact and portable.

I claim:

1. A ramp for allowing egress and ingress to and from a landing base and a boat having a deck comprising:

(a) a plank having a rear end to be supported near the boat and a front end to be supported near the base; and (b) a foldable hand rail assembly comprising a pair of hand rails mounted on opposite sides of the plank, each rail mounted by a rear end brace bent so as to have an off-set lower segment, each lower rear brace segment being pivotally mounted to opposite sides of the plank, the tops of the rear braces being pivotally engaged near the rear ends of their respective hand rails, and each rail mounted by a front end brace pivotally mounted on opposite sides of the plank, each front brace being pivotally engaged to each rail near the front end of the rail, the braces being mounted to the plank at an angle so that when the braces pivot from a lowered position to an upright position they are tilted at an angle outwardly away from the sides of the plank to provide a passageway between the hand rails of greater width than the plank width; and (c) means to adjustably mount the rear plank end to the boat comprising link chains having their lower ends secured to the plank near the rear end of the plank and their upper ends secured to the boat to allow the rear end of the plank to be supported a selected position beneath the level of the boat deck;

(d) means to latch the hand rail braces when they are in an upright position; and (e) foldable legs pivotally mounted near the front end of the plank and extendable outwardly from the sides of the plank to support the front end of the plank on the landing base.

2. The structure of claim 1 wherein the plank has cavities to receive the chains and part of the braces in a folded position, and cavities to receive the legs in a folded position.

3. The structure of claim 1 wherein the chains are engaged to the boat by clips pivotally mounted to the boat, each clip having a pair of lower and upper parallel sections joined by an off-set midsection to elevate the upper clip section above the boat deck, the upper part of the clip having an opening to receive a chain link, and a spring latch associated with the clip to block the opening when the link is inserted therein.

4. A ramp for allowing egress and ingress to and from a landing base and a boat having a deck comprising:

(a) a plank having a rear end to be supported near the boat and a front end to be supported near the base; and (b) rear end plank supports comprising flexible members having ends with means to be engaged to the boat and means to be engaged to the rear end of the plank to support the plank;

(c) a foldable hand rail assembly having a hand rail supported by a pair of braces pivotally connected at either end of the hand rail and pivotally connected to the plank;

(d) means for engaging a brace when the braces are upright to hold the hand rail in fixed position relative to the plank;

(e) the plank having an integral channel to receive a flexible support member and to receive portions of the pair of braces and hand rail, and latching means to hold the hand rail to the plank to allow the ramp to be carried by grasping the hand rail.

5. A ramp for allowing egress and ingress to and from a landing base and a boat having a deck comprising:

(a) a plank having a rear end to be supported near the boat and a front end to be supported near the base; and (b) rear end plank supports comprising flexible members having ends with means to be engaged to the boat and means to be engaged to the rear end of the plank to support the plank; and (c) a hand rail assembly comprising a pair of hand rails, each rail having a front and rear end, the rails extending in the same general direction of the ramp, each rail being supported by a rear brace and a front brace pivotally connected near the rear and front ends of each hand rail respectively, and means for pivotally connecting each pair of the rear and front braces near the plank sides at an angle so that when the braces are moved from a lowered position alongside the plank to an upright position relative to the plank, the braces on both sides of the plank extend at an angle outwardly away from the sides of the plank.

6. The structure of claim 5 wherein the flexible members extend from near the rear end of the plank around the outside of the rear end braces to frictionally engage those braces to restrain movement of the ramp.

7. The structure of claim 6 wherein the flexible members are chains having links with flexible cover sheathes around a portion of each chain between the connections of the chains to the ramp and to the boat.

8. The structures of claim 7 wherein the chains are engaged to the boat by clips pivotally mounted to the boat so that the clips pivot with movement of the chains against the clips.

9. A ramp for allowing egress and ingress to and from a landing base and a boat having a deck comprising:

(a) a plank having a rear end to be supported near the boat and a front end to be supported near the base; and (b) rear end plank supports comprising flexible members having ends with means to be engaged to the boat and means to be engaged to the rear end of the plank to support the plank;

(c) a foldable hand rail assembly comprising a pair of hand rails, each rail being supported by a rear end and front end brace pivotally connected to near the rear and front ends of each hand rail respectively, and pivotally connected to the sides of the plank, the rear braces having offset lower segments for positioning the plank away from the boat; and (d) means for engaging a brace on each side of the plank when the braces are moved to an upright position to hold the hand rails in fixed position relative to the plank.

10. A walk ramp for allowing walking egress and ingress to and from a solid landing base and a boat having a deck, comprising;

(a) a walk plank having a rear end to be supported near the boat and a front end to be supported by the solid landing base; and (b) rear end walk plank supports comprising flexible members having ends with means to be engaged to the boat and means to be engaged to the rear end of the walk plank to support the rear walk plank end away from the deck and the boat to allow movement of the rear end of the walk plank relative to the boat when the walk plank supports are engaged to the boat and adjustable to allow the level of the rear walk plank end to be raised or lowered relative to the deck to adjust the angle of inclination of the walk plank relative to the deck while the level of the front walk plank end relative to the deck remains the same so that humans can walk upon the plank from the front end to the rear end, and from the rear end to the front end to travel to and from the landing base and the boat;

(c) a foldable hand rail assembly having a hand rail supported by a pair of braces pivotally connected at either end of the hand rail and pivotally connected to the plank; and (d) a pair of foldable legs mounted near the plank front end extendable in a single direction both downwardly from the bottom of the plank and outwardly from the sides of the plank to support the plank above the landing base.

11. A ramp for allowing egress and ingress to and from a landing base and a boat having a deck comprising:

(a) a plank having a rear end to be supported near the base; and (b) rear end plank supports comprising flexible members having ends with means to be engaged to the boat and means to be engaged to the rear end of the plank to support the rear plank end away from the deck and the boat to allow movement of the rear end of the plank relative to the boat when the plank supports are engaged to the boat and adjustable to allow the level of the rear plank end to be raised or lowered relative to the deck to adjust the angle of inclination of the plank relative to the deck while the level of the front plank end relative to the deck remains the same; and further comprising a foldable hand rail assembly having a hand rail supported by a pair of braces pivotally connected at either end of the hand rail and pivotally connected to the plank; and means for engaging a brace when the braces are upright to hold the hand rail in fixed position relative to the plank; and (c) the plank having an integral channel to receive a flexible support member and to receive portions of the pairs of braces and hand rail, and latching means to hold the hand rail to the plank to allow the ramp to be carried by grasping the hand rail.

12. The structure of claim 11 wherein the flexible members are link chains, and latching members on the boat to engage the chain links so that the position of the plank can be adjusted by adjustment of the chain links engaged to the chain latching members.

13. A ramp for allowing egress and ingress to and from a landing base and a boat having a deck comprising:

(a) a plank having a rear end to be supported near the base; and (b) rear end plank supports comprising flexible members having ends with means to be engaged to the boat and means to be engaged to the rear end of the plank to support the rear plank end away from the deck and the boat to allow movement of the rear end of the plank relative to the boat when the plank supports are engaged to the boat and adjustable to allow the level of the rear plank end to be raised or lowered relative to the deck to adjust the angle of inclination of the plank relative to the deck while the level of the front plank end relative to the deck remains the same; and (c) a hand rail assembly comprising a pair of hand rails, each rail having a front and rear end, the rails extending in the same general direction of the ramp, each rail being supported by a rear brace and a front brace pivotally connected near the rear and front ends of each hand rail respectively, and means for pivotally connecting each pair of the rear and front braces near the plank sides at an angle so that when the braces are moved from a lowered position alongside the plank to an upright position relative to the plank, the braces on both sides of the plank extend at an angle outwardly away from the sides of the plank.

14. The structure of claim 13 wherein the flexible members extend from near the rear end of the plank around the outside of the rear end braces to frictionally engage those braces to restrain movement of the ramp.

15. The structure of claim 14 wherein the flexible members are chains having links with flexible cover sheathes around a portion of each chain between the connections of the chains to the ramp and to the boat.

16. The structures of claim 15 wherein the chains are engaged to the boat by clips pivotally mounted to the boat so that the clips pivot with movement of the chains against the clips.

17. A ramp for allowing egress and ingress to and from a landing base and a boat having a deck comprising:

(a) a plank having a rear end to be supported near the base; and (b) rear end plank supports comprising flexible members having ends with means to be engaged to the boat and means to be engaged to the rear end of the plank to support the rear plank end away from the deck and the boat to allow movement of the rear end of the plank relative to the boat when the plank supports are engaged to the boat and adjustable to allow the level of the rear plank end to be raised or lowered relative to the deck to adjust the angle of inclination of the plank relative to the deck while the level of the front plank end relative to the deck remains the same;

(c) a foldable hand rail assembly comprising a pair of hand rails, each rail being supported by a rear end and front end brace pivotally connected to near the rear and front ends of each hand rail respectively, and pivotally connected to the sides of the plank, the rear braces having offset lower positions for positioning the plank away from the boat; and (d) means for engaging a brace on each side of the plank when the braces are moved to an upright position to hold the hand rails in fixed position relative to the plank.

* * * * *